US007101344B1

(12) United States Patent
Wu

(10) Patent No.: US 7,101,344 B1
(45) Date of Patent: Sep. 5, 2006

(54) MULTI-FUNCTIONAL FLOAT BOARD STRUCTURE

(76) Inventor: Hsi-Fen Wu, No. 10, Lane 427, Sec. 6, Chung Shan North Rd., Shih Lin District, Taipei City (TW)

( * ) Notice: Subject to any disclaimer, the term of this patent is extended or adjusted under 35 U.S.C. 154(b) by 379 days.

(21) Appl. No.: 10/407,981

(22) Filed: Apr. 7, 2003

(51) Int. Cl.
*A61H 7/00* (2006.01)

(52) U.S. Cl. ..... 601/28; 601/134; 601/136; 441/129

(58) Field of Classification Search ..... 601/23, 601/27–29, 134–138; 606/204; 441/55, 441/60, 65, 76, 88, 129; 482/19, 79; D21/803
See application file for complete search history.

(56) References Cited

U.S. PATENT DOCUMENTS

| | | | | |
|---|---|---|---|---|
| 3,147,498 | A * | 9/1964 | Convis | 441/65 |
| 4,253,661 | A * | 3/1981 | Russell | 482/79 |
| 5,056,507 | A * | 10/1991 | Yum | 601/136 |
| 5,518,429 | A * | 5/1996 | Gravlin | 441/65 |
| 6,244,992 | B1 * | 6/2001 | James | 482/79 |

* cited by examiner

*Primary Examiner*—Quang D. Thanh
(74) *Attorney, Agent, or Firm*—Egbert Law Offices

(57) ABSTRACT

A multi-functional float board structure uses a wedge shape design and is constructed with buoyant materials. The float board includes an the inclined surface design on one side of the float board which when placed on a level surface can facilitate foot stretching for a user prior to any aquatic activities. Furthermore, massage nodes on the inclined surface serve as a sole massage device when a user steps on the incline surface.

2 Claims, 5 Drawing Sheets

MULTI-FUNCTIONAL FLOAT BOARD STRUCTURE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

This invention pertains to a float board structure, especially to a new multidimensional design for providing both foot stretching and sole massage functions.

BACKGROUND OF THE INVENTION

Float boards as a swimming aid, facilitate swimmers in aquatic practices such as floating and kicking based on its buoyant nature. Most prior art float boards with a known flat panel design does not provide additional functionality, besides variation in shapes, colors and materials. Any new product development based on existing structure will not be able to create new competitive products while simultaneously satisfying the multilateral requirements of consumers.

To cope with the single-function, lack of innovation and competition deficiencies of the prior art float board design, the industry needs to invent a multi-functional, practical and innovative new structure.

BRIEF SUMMARY OF THE INVENTION

The facts of the functionality enhancement of this innovation as follows.

Based on the architecture design of the incline surface, the slope provided by the incline surface can facilitate users for foot stretching before any aquatic activities when the float board is placed on a level surface. This creates an additional functionality for the float board.

The implementation of the massage nodes provides sole massage functionality when the user steps his/her foot on the incline surface.

New functionality provided by this innovation is as follows.

When two wedges connect, the incline surface can be adjusted to be a level surface by reversing the cascading directions to suit user's requirements under various circumstances.

DETAILED DESCRIPTION OF THE INVENTION

To facilitate a further understanding and clarification on the purpose, characteristics and functionality to this innovation, the listed figures with the detail descriptions follow.

Figure 1:
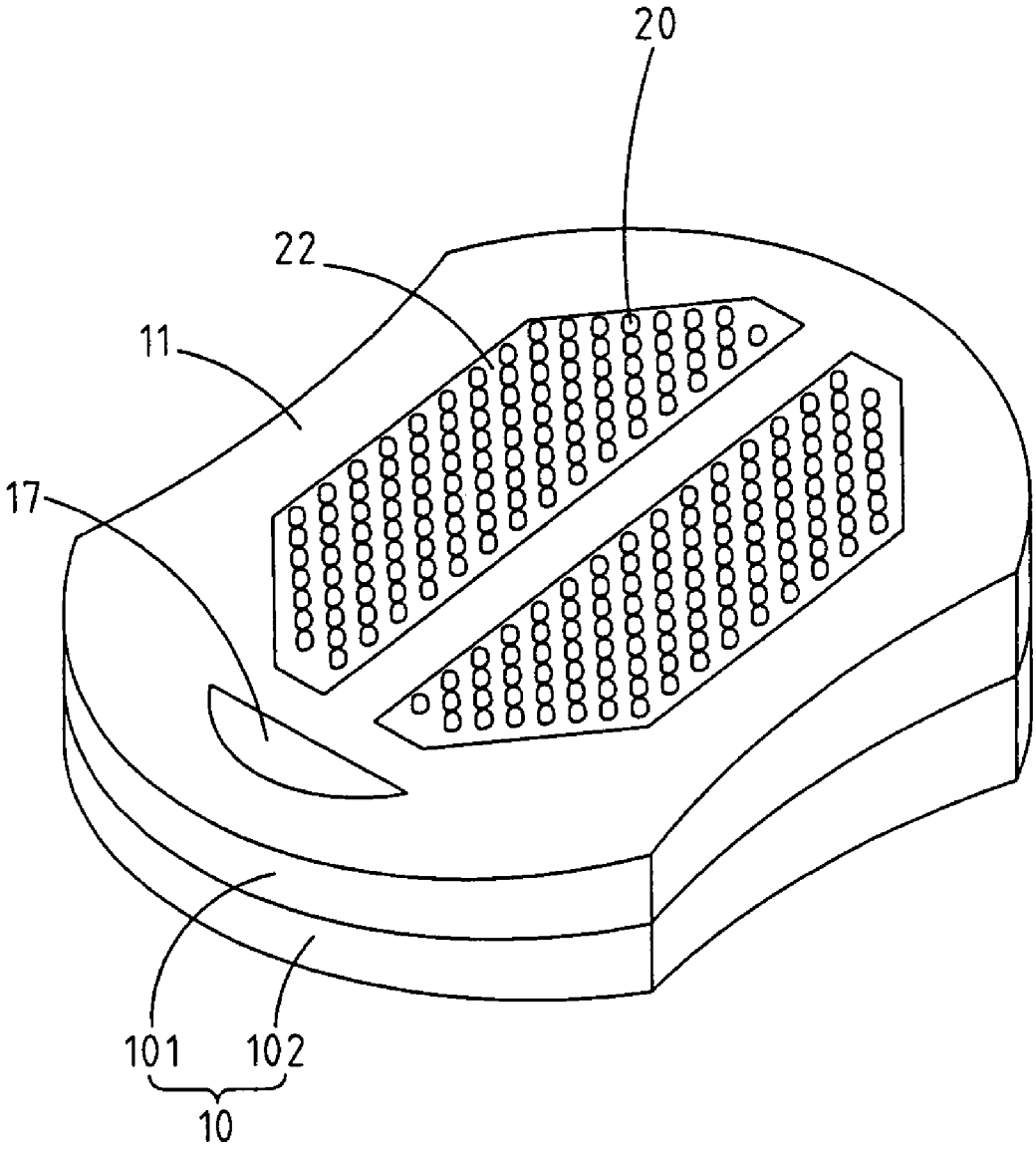
FIG. 1 is an upper perspective view of the present invention.
Figure 2:
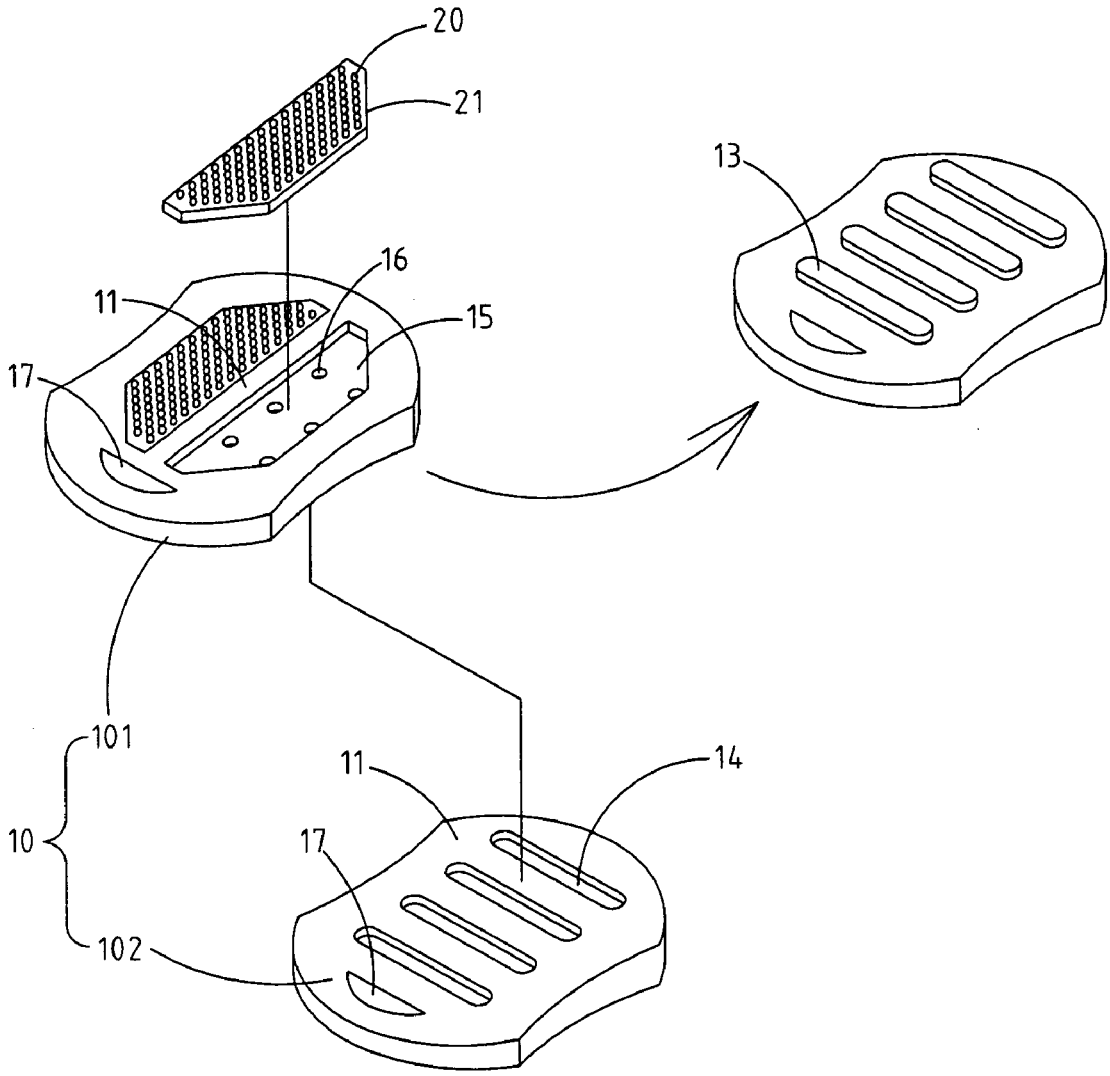
FIG. 2 is an exploded perspective view of the present invention.
Figure 3:
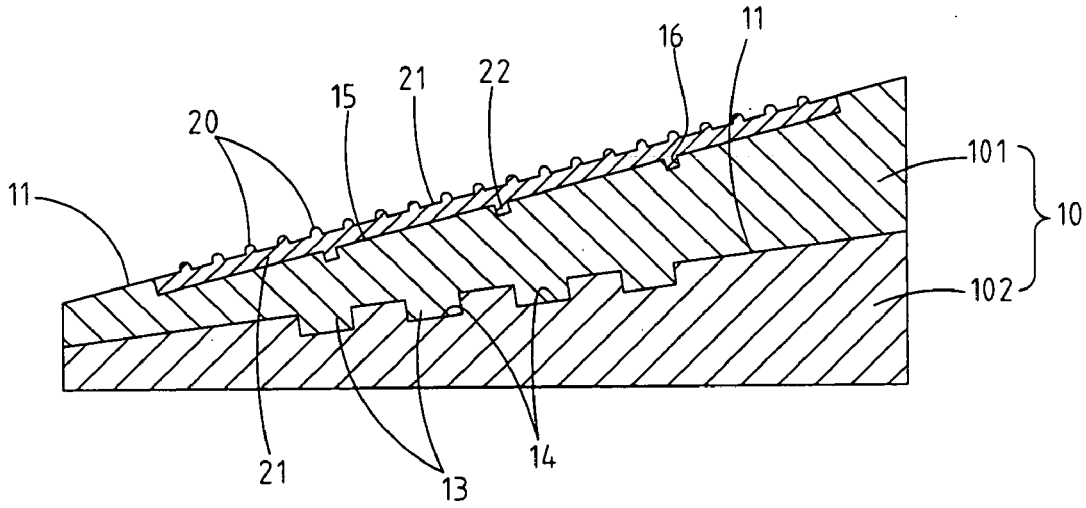
FIG. 3 is a side sectional view of the present invention.

First, referring to illustrations in FIGS. 1, 2 and 3 as the preferred implementation example of this innovative float board structure, the float board (10) uses a wedge shape design and is constructed with buoyant materials. The major enhancements include one side of the float board (10) being designed as an incline surface (11).

Figure 6:
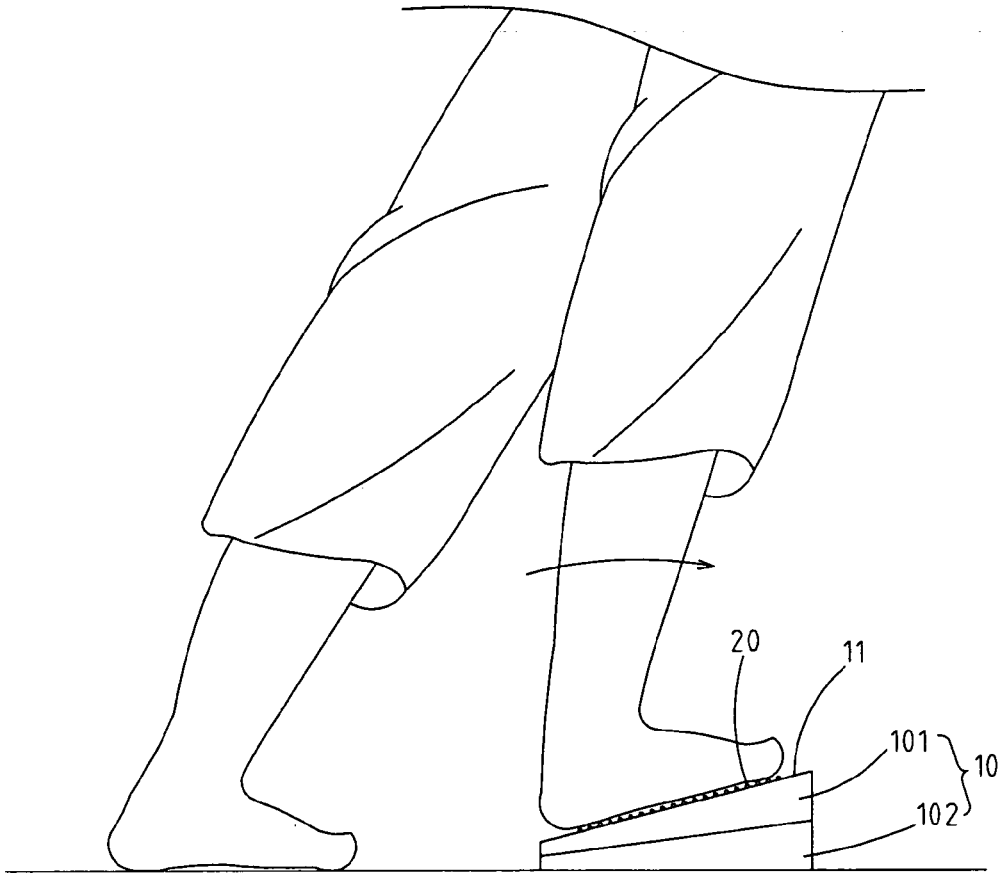
FIG. 6 is a plan view of the present invention in use.

Thus, when the float board (10) is placed on a level surface, the slope created by the incline surface (11) can provide foot stretching (FIG. 6) for a user. The characteristic of the innovation is to generate an additional capability for the float board.

Figure 4:
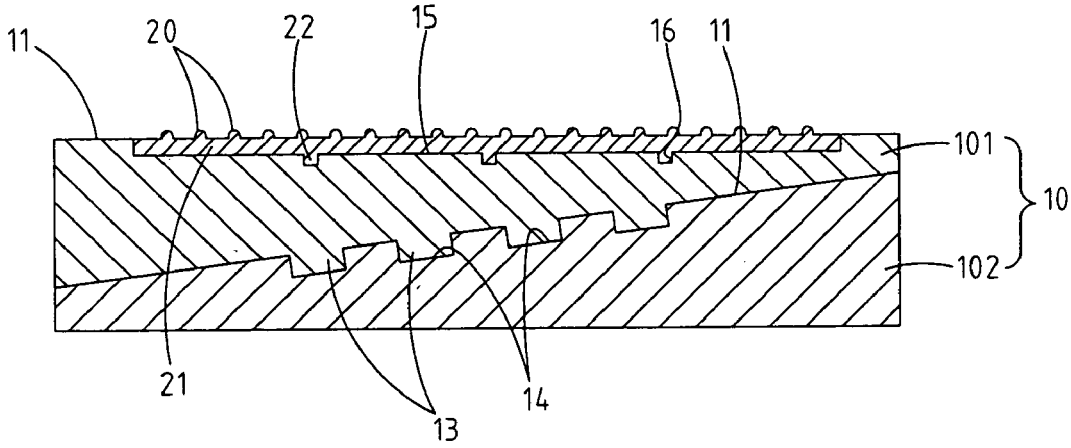
FIG. 4 another side sectional view of the present invention.
Figure 5:
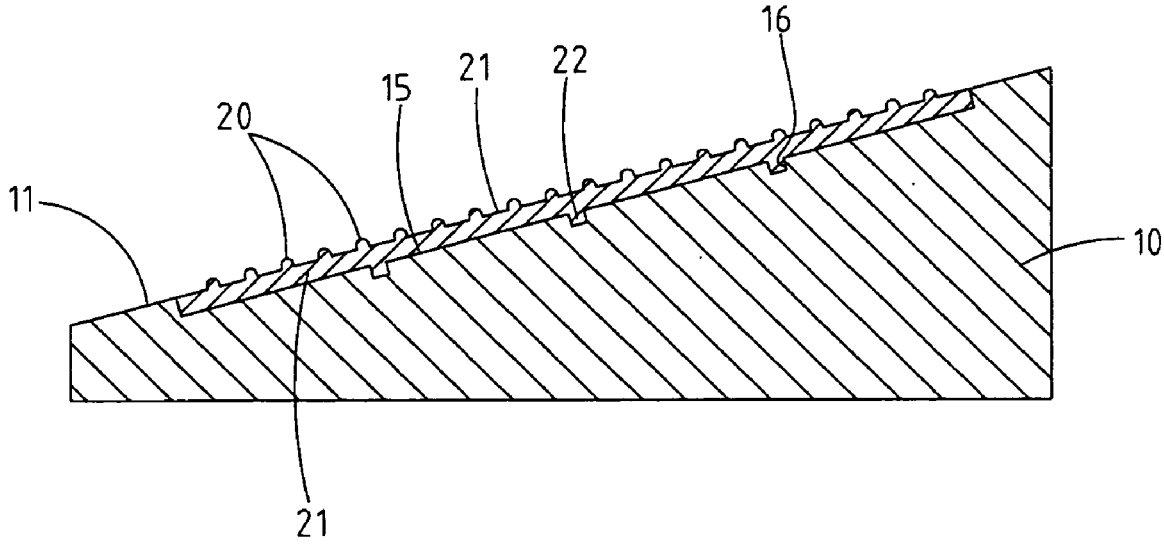
FIG. 5 is a side sectional view of a single wedge structure of the present invention.

The float board (10) can use single wedge architecture (FIG. 5) or as shown in FIGS. 1, 2 and 3 as a combination of two wedges. Each of the two wedges (101, 102) consists of one incline surface (11) with complementary cavities (14) and bulges (13) on the cascading surface for adhesiveness. Thus, the slope (11) of the incline surface can be adjusted using the difference within a single wedge or between two wedges. When reversing the cascading direction of two wedges (101, 102) as shown in FIG. 4, the incline surface (11) can be adjusted to a level surface to suit user's requirements under various circumstances such as use as a stool or a step. Apparently, the level surface situation is more appropriate.

The incline surface (11) is provided with massage nodes (20); the structure can be implemented as follows.

As shown in FIGS. 2 and 3, channels (15) are first created on the incline surface (11) of the float board (10) and then cover with a massage board (21) using interleaving massage nodes (20) on the surface made from hardened plastics. The bottom of the massage board (21) and the channels (15) of the float board (10) are constructed with complementary cohesive pillars (22) and notches (16) to facilitate the positioning of the massage board. This provides the sole massage functionality when the user steps his/her feet on the incline surface (11).

An opening (17) with the size of a palm can be implemented on one side of the float board (10) for ease of handling.

I claim:

1. A float apparatus comprising:

a first wedge-shaped board formed of a buoyant material, said first wedge-shaped board having an inclined surface on one side thereof, said inclined surface having a plurality of cavities formed thereon;

a second wedge-shaped board formed of a buoyant material, said second wedge-shaped board having an inclined surface on one side thereof, said inclined surface of said second wedge-shaped board having a plurality of bulges formed thereon, said plurality of bulges respectively received by said plurality of cavities, said second wedge-shaped board having channels formed on an opposite side thereof, said channels having notches formed therein;

at least one massage board received on an said opposite side of said second wedge-shaped board, the massage board having massage nodes thereon formed of a hardened polymeric material, said massage board being positioned in the channel such that pillars on a bottom of the massage board are connected to said notches of the channel so as to facilitate a positioning of the massage board.

2. The apparatus of claim 1, said second wedge-shaped board having an opening of a size suitable for receiving a human palm therein.

* * * * *